United States Patent [19]

Riutort et al.

[11] Patent Number: 4,471,497

[45] Date of Patent: Sep. 18, 1984

[54] LAVATORY FILTER

[76] Inventors: Aramis R. Riutort, c/o George Spector, 3615 Woolworth Bldg., 233 Broadway; George Spector, c/o Aramis Rodriguez Riutort, 3615 Woolworth Bldg., 233 Broadway, both of New York, N.Y.

[21] Appl. No.: 409,969

[22] Filed: Aug. 20, 1982

[51] Int. Cl.[3] ..... A47K 1/14; E03C 1/26

[52] U.S. Cl. ..... 4/286; 4/292

[58] Field of Search ..... 4/292, 286, 309

[56] References Cited

U.S. PATENT DOCUMENTS

| | | | |
|---|---|---|---|
| 1,494,882 | 5/1924 | Barger | 4/292 |
| 1,592,866 | 7/1926 | Murphy | 4/292 |
| 2,094,286 | 9/1937 | Vogt | 4/292 |
| 2,518,205 | 8/1950 | Vinokor | 4/292 |
| 2,695,411 | 11/1954 | Vinokor | 4/292 |
| 3,702,013 | 11/1972 | Gebert | 4/292 X |
| 3,742,524 | 7/1973 | Ballantine | 4/292 X |
| 3,788,485 | 1/1974 | Bruning | 4/292 X |

*Primary Examiner*—Henry K. Artis

[57] ABSTRACT

A lavatory filter for a sink drainage well is provided and consists of a flat annular ring member having an outer circumference larger than the sink drainage well whereby the flat annular ring member will sit on top of the sink drainage well, an annular dome shaped strainer member affixed at its outer edge to the inner circumference of the flat annular ring member and a plurality of curved leaf springs each one having one end affixed to the inner circumference of the flat annular ring member below the annular dome shaped strainer member and bent downwardly to engage the inner peripheral wall surface of the sink drainage well.

1 Claim, 6 Drawing Figures

LAVATORY FILTER

BACKGROUND OF THE INVENTION

The instant invention relates generally to sinks and more specifically it relates to a lavatory filter for a sink drainage well.

It is a known fact that sometimes when a person washes in a sink, an object such as a ring, a bracelet, a pen part or any other small article can fall into the drainage well. This can block up the drainage well or pipe preventing the proper discharge of water. To get the object out one must open the drainage well and the pipes to remove it. This is a problem, so accordingly the situation is in need of an improvement.

SUMMARY OF THE INVENTION

A principle object of the present invention is to provide a lavatory filter that will sit on top of and be secured to a sink drainage well preventing small objects from falling into the sink drainage well.

Another object is to provide a lavatory filter that is constructed and arranged to cooperate with the contour of the sink.

An additional object is to provide a lavatory filter that has a replaceable annular dome shaped strainer member.

A further object is to provide a lavatory filter that is economical in cost to manufacture.

A still further object is to provide a lavatory filter that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 4:
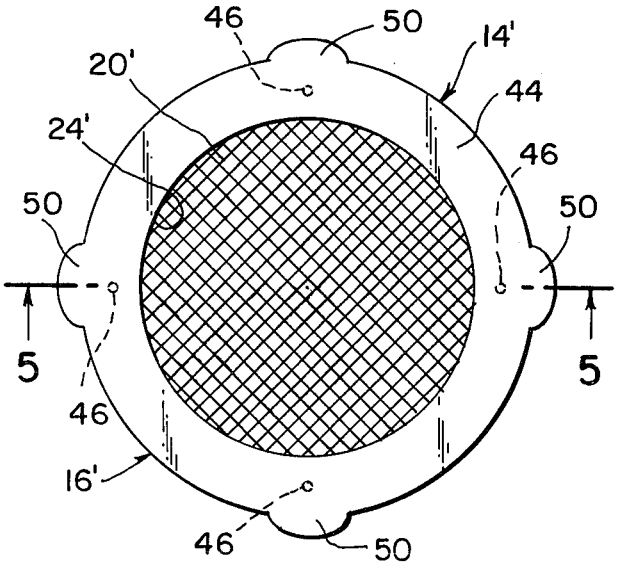
FIG. 4 is a top plan view of another embodiment of the invention.
Figure 5:
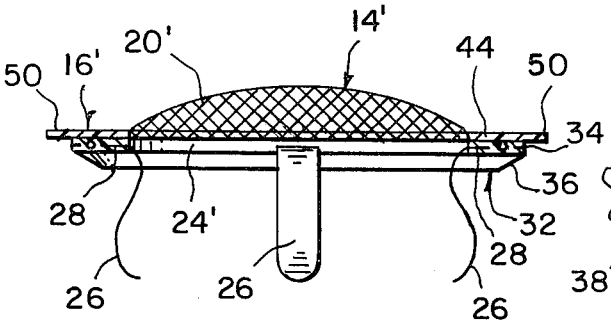

FIG. 5. is a cross-sectional view taken along line 5—5 in FIG. 4.

Figure 6:
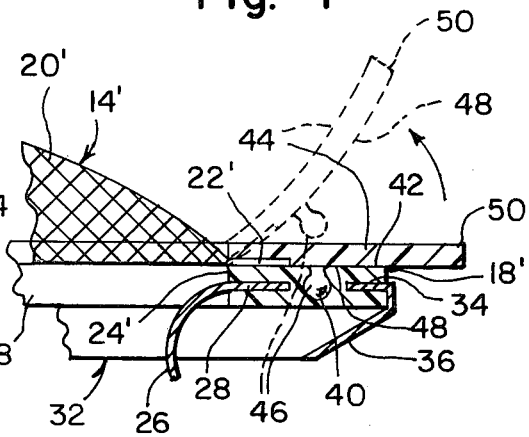

FIG. 6 is an enlarged cross-sectional detail view.

DETAILED DESCRIPTION OF THE PREFERRED EMBODIMENT

Figure 1:
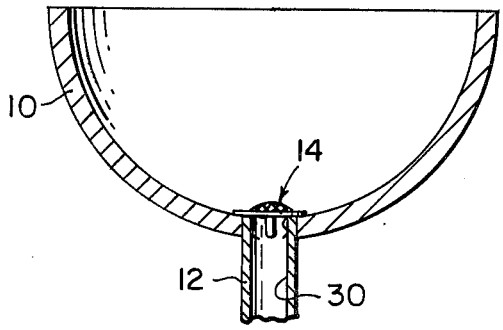
FIG. 1 is a cross-sectional view of a sink with the invention in use.
Figure 2:
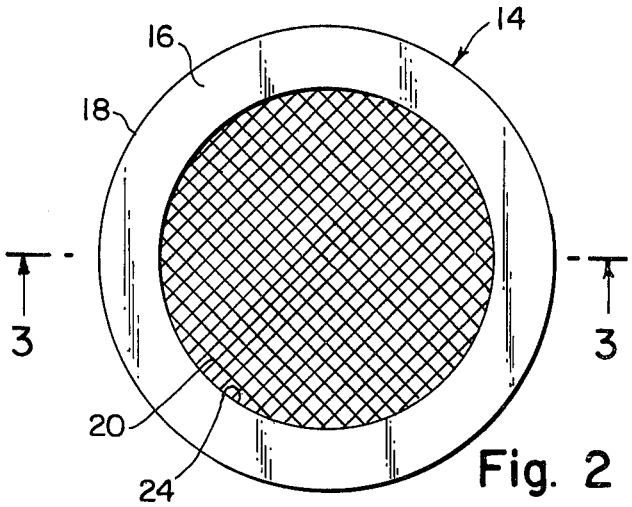
FIG. 2 is a top plan view of the invention.
Figure 3:
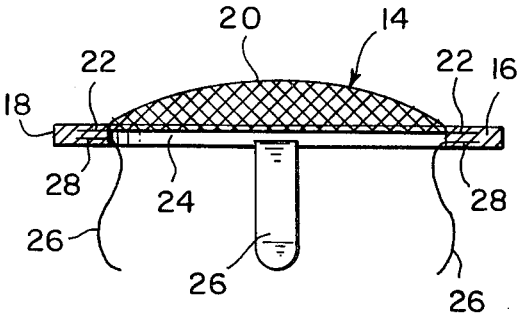
FIG. 3 is a cross-sectional view taken along line 3—3 in FIG. 2.

Turning now descriptively to the drawings, in which similar reference characters denote similar elements throughout the several views, FIG. 1 illustrates a sink 10 with a drainage well 12. A lavatory filter 14 sits on top of and is secured to the sink drainage well 12. FIGS. 2 and 3 shows the lavatory filter 14 in greater detail. The lavatory filter 14 consists of a flat annular ring member 16 having an outer circumference 18 larger than the sink drainage well 12 whereby the flat annular ring member 16 will sit on top of the sink drainage well 12. An annular dome shaped strainer member 20 is affixed at its outer edge 22 to the inner circumference 24 of the flat annular ring member 16. A plurality of curved leaf springs 26 are provided for securing the flat annular ring member 16 to the top of the sink drainage well 12. Each curved leaf spring 26 has one end 28 affixed to the inner circumference 24 of the flat annular ring member 16 below the annular dome shaped strainer member 20 and bent downwardly to engage the inner peripheral wall surface 30 of the sink drainage well 12.

FIGS. 4, 5 and 6 show another embodiment of the invention. The lavatory filter 14' has an annular seat member 32 affixed at 34 to the outer circumference 18' of the flat annular ring member 16'. The annular seat member 32 has a peripheral edge surface 36 inclined inwardly and downwardly and constructed and arranged to cooperte with the contour of the sink 10.

The flat annular ring member 16' further contains a lower base portion 38 having a plurality of sockets 40 around the top surface 42 and an upper portion 44 having a plurality of projections 46 around bottom surface 40. Each projection 46 mates with each socket 40 on the lower base portion 30 holding the outer edge 22' of the annular dome shaped strainer member 20' in a fixed position.

The upper portion 44 also has a plurality of finger grips 50. Each finger grip 50 extends beyond the outer circumference 18' of the lower base portion 38 so that the upper portion 44 can be removed freeing the outer edge 22' of the annular dome shaped strainer 20' allowing the annular dome shaped strainer 20' to be replaced.

The flat annular ring members 16 and 16' can be made of any suitable material such as metal or plastic. The annular dome shaped strainer members 20 and 20' are made out of metal mesh material. The curved leaf springs 26 can be made out of any flexible material such as any metal or plastic. The annular seat member 32 is made out of metal but plastic can be used.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lavatory filter for a sink drainage well which comprises:

(a) a flat annular ring member having an outer circumference larger than said sink drainage well whereby said flat annular ring member will sit on top of said sink drainage well;

(b) an annular dome shaped strainer member affixed at its outer edge to the inner circumference of said flat annular ring member; and (c) means for securing said flat annular ring member to said top of said sink drainage well, wherein said annular dome shaped strainer member is made out of metal mesh material, wherein said means for securing said flat annular ring member to said top of said sink drainage well is a plurality of curved leaf springs each one having one end affixed to said inner circumference of said flat annular ring member below said annular dome shaped strainer member and bent downwardly to engage the inner peripheral wall surface of said sink drainage well, including a means for conforming said flat annular ring member to the contour of the sink, wherein means for conforming said flat annular ring member to the contour of the sink is an annual seal seat member affixed to said outer circumference of said flat annular ring member having a peripheral edge surface inclined inwardly and downwardly, in order to cooperate with the contour of said sink wherein said flat annular ring member further comprises:

(a) lower base portion having a plurality of sockets around top surface; and (b) an upper portion having a plurality of projections around bottom surface, each said projection adapted to mate with each said socket on said lower base portion holding said outer edge of said annular dome shaped strainer member in an affixed position, said upper portion also having a plurality of finger grips, each of said finger grip extends beyond said outer circumference of said lower base portion so that outer circumference of said lower base portion so that said upper portion can be removed freeing said outer edge of said annular dome shaped strainer allowing said annular dome shaped strainer to be replaced.

* * * * *